United States Patent [19]

Rozzi

[11] 4,390,125

[45] Jun. 28, 1983

[54] TUBE-FIRED RADIANT HEATING SYSTEM

[75] Inventor: Mario Rozzi, St. Clair Shores, Mich.

[73] Assignee: Detroit Radiant Products Company, Detroit, Mich.

[21] Appl. No.: 233,838

[22] Filed: Feb. 12, 1981

[51] Int. Cl.[3] ..... F24H 3/00

[52] U.S. Cl. ..... 237/70; 126/92 AC; 126/92 B; 431/353; 431/19

[58] Field of Search ..... 237/70; 126/92 AC, 92 B; 431/353, 19

[56] References Cited

U.S. PATENT DOCUMENTS

| | | | |
|---|---|---|---|
| 3,180,394 | 4/1965 | Conway | 431/353 |
| 3,805,763 | 4/1974 | Cowan | 126/92 B |
| 3,946,719 | 3/1976 | Bark et al. | 126/92 C |
| 4,013,395 | 3/1977 | Wormser | 431/353 |
| 4,080,149 | 3/1978 | Wolfe | 431/19 |

FOREIGN PATENT DOCUMENTS

| | | | |
|---|---|---|---|
| 52-135797 | 5/1977 | Japan | 126/92 AC |

*Primary Examiner*—William R. Cline
*Assistant Examiner*—John F. McNally

[57] ABSTRACT

The tube-fired radiant heating system is of the type where an elongated tube is heated by hot gases of combustion which are passed. The heated tube radiates heat to the space to be heated therethrough.

A burner is provided at one end of the tube to burn an air/fuel mixture. The products of combustion are forced through the tube by means of a blower provided at the tube inlet. Burning takes place within the tube. A tubular stream of air is constantly passed over the flame to protect the tube from the high heat of combustion.

7 Claims, 2 Drawing Figures

TUBE-FIRED RADIANT HEATING SYSTEM

BACKGROUND OF THE INVENTION

1. Field of the Invention

The invention relates to improvements in radiant heating systems of the type including a burner and an elongated heat radiating tube through which hot gases of combustion are passed.

2. Description of the Prior Art

Heating systems of the present type have been proposed in the past. One problem with such systems is that the high heat of the flame and initially the products of combustion can cause relatively rapid deterioration of the tube being heated. One technique for minimizing this problem is to pass a cylinder of air around the flame and early products of combustion to prevent contact thereof with the tube. This technique is illustrated in U.S. Pat. Nos. 3,399,833 (Sept. 3, 1968) and 4,044,751 (Aug. 30, 1977).

However, these patents each teach drawing of the exhaust gases through the tube by means of an exhaust fan provided at the outlet of the tube. A negative pressure is provided within the tube to prevent any leakage of fuel or products of combustion to the space being heated.

In accordance with the present invention, an effective cylindrical air stream is provided as desired by pressure in the tube created by means of a blower at the tube inlet. Two pressure checks are constantly made to ensure proper operation. Fuel is directly injected and burned within the tube, thus preventing any leaks at the tube inlet. A sealed compartment is also provided at the inlet. The one opening into the tube, other than at its inlet, is protected against leakage by means of a positive air pressure at that point.

SUMMARY OF THE INVENTION

The tube-fired radiant heating system comprises an elongated radiant heating tube having an inlet end and an exhaust end. A relatively short tube of smaller diameter than the radiant heating tube is positioned in the inlet end of the radiant heating tube and spaced from the inner surface thereof to define therewith a cylindrical passage for flow of air. A burner is postioned within the short tube. The burner has an inlet end to receive air and fuel, means for mixing air and fuel, and an exit end for emitting the air/fuel mixture for combustion closely adjacent thereto. Power means are provided for continually forcing air into the inlet end of the burner and through the cylindrical passage to form a cylinder of air around burning air/fuel mixture emitted from the burner to shield the radiant heating tube from impingement of the flame of burning air/fuel mixture.

IN THE DRAWINGS

DETAILED DESCRIPTION OF THE SPECIFIC EMBODIMENT

Figure 1:
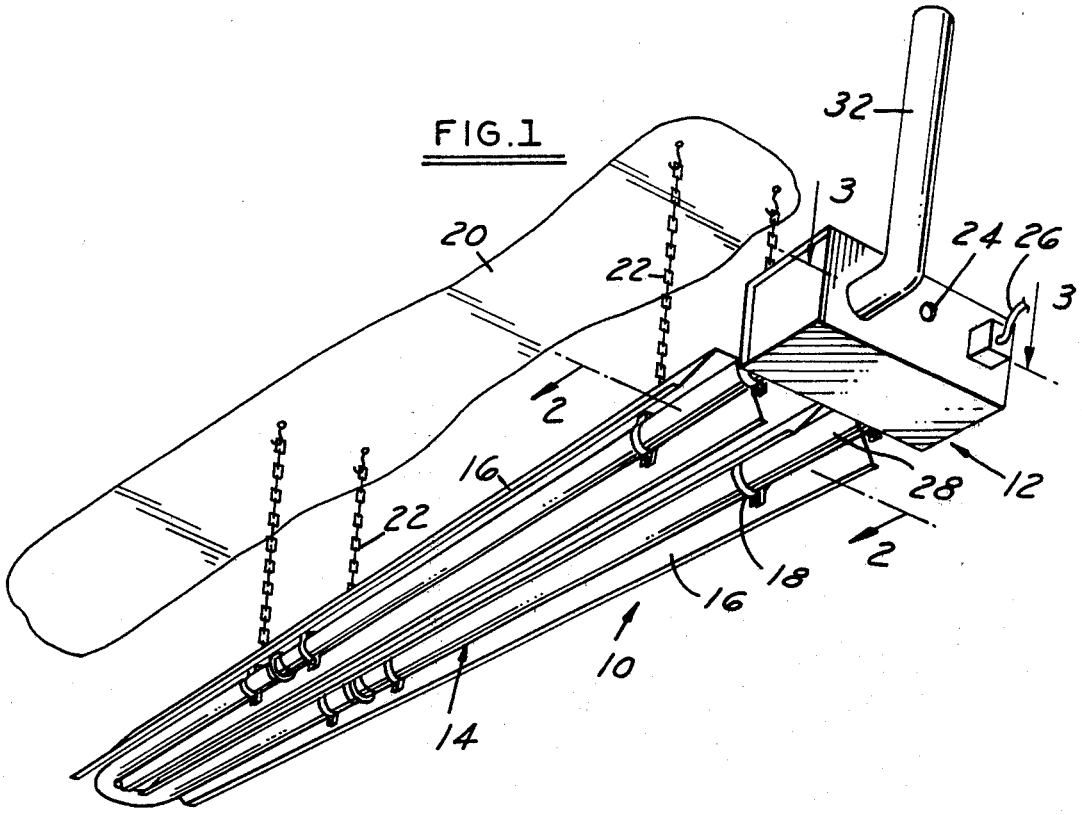
FIG. 1 is a perspective view of one embodiment of tube-fired radiant heating system of the present invention.
Figure 2:
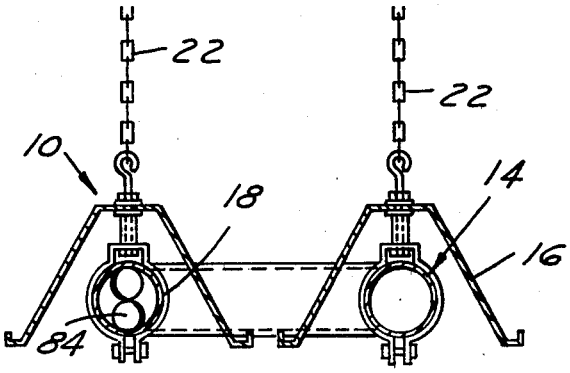
FIG. 2 is a sectional view taken substantially along the line 2—2 of FIG. 1 looking in the direction of the arrows.

FIGS. 1 and 2 illustrate a typical installation of the tube-fired radiant heating system 10 of the present invention in a building to be heated thereby. The heating system 10 includes a component housing 12 from which extends an elongated U-shaped tube 14. Tube 14 is secured to a reflector 16 by means of a plurality of brackets 18. This entire structure is suspended from ceiling 20 by means of chains 22. The chains 22 space the structure from the ceiling 20 so as to avoid undue heating of the ceiling 20.

Operationally, air enters housing 12 through opening 24 and fuel enters via line 26. The fuel is normally natural gas. The air and fuel are suitably mixed and then burned in the portion 28 of U-shaped tube 14 closely adjacent to housing 12 by means of structure to be described. The hot products of combustion travel through U-shaped tube 14 thereby heating this tube.

Typically, the hot gases of combustion may initially be in the range of 800°-900° F. As these gases pass through U-shaped tube 14, they cool at the exit end 30, the range is about 300°-350° F. This is assuming tube 14 is a steel tube, fourty feet long and with a four inch diameter. Such a system is rated at 75,000 BTU's.

When the U-shaped tube 14 is heated, it will radiate thermol energy at a relatively low intensity level so as to heat the space below at a suitable comfort level. The reflector 16 reflects radiated heat away from ceiling 20 toward the floor so as to direct the heat where it is desired.

The cooled products of combustion exit via tube portion 32 which extends from housing 12. Normally, the spent gases are exhausted to the atmosphere outside of the building being heated, although in some buildings the gases may be directly exhausted within the building at a point above the heating system 10. While a U-shaped tube 14 has been shown, a straight tube may be used in some applications. Also, the system capacity may be varied from that previously described.

Figure 3:
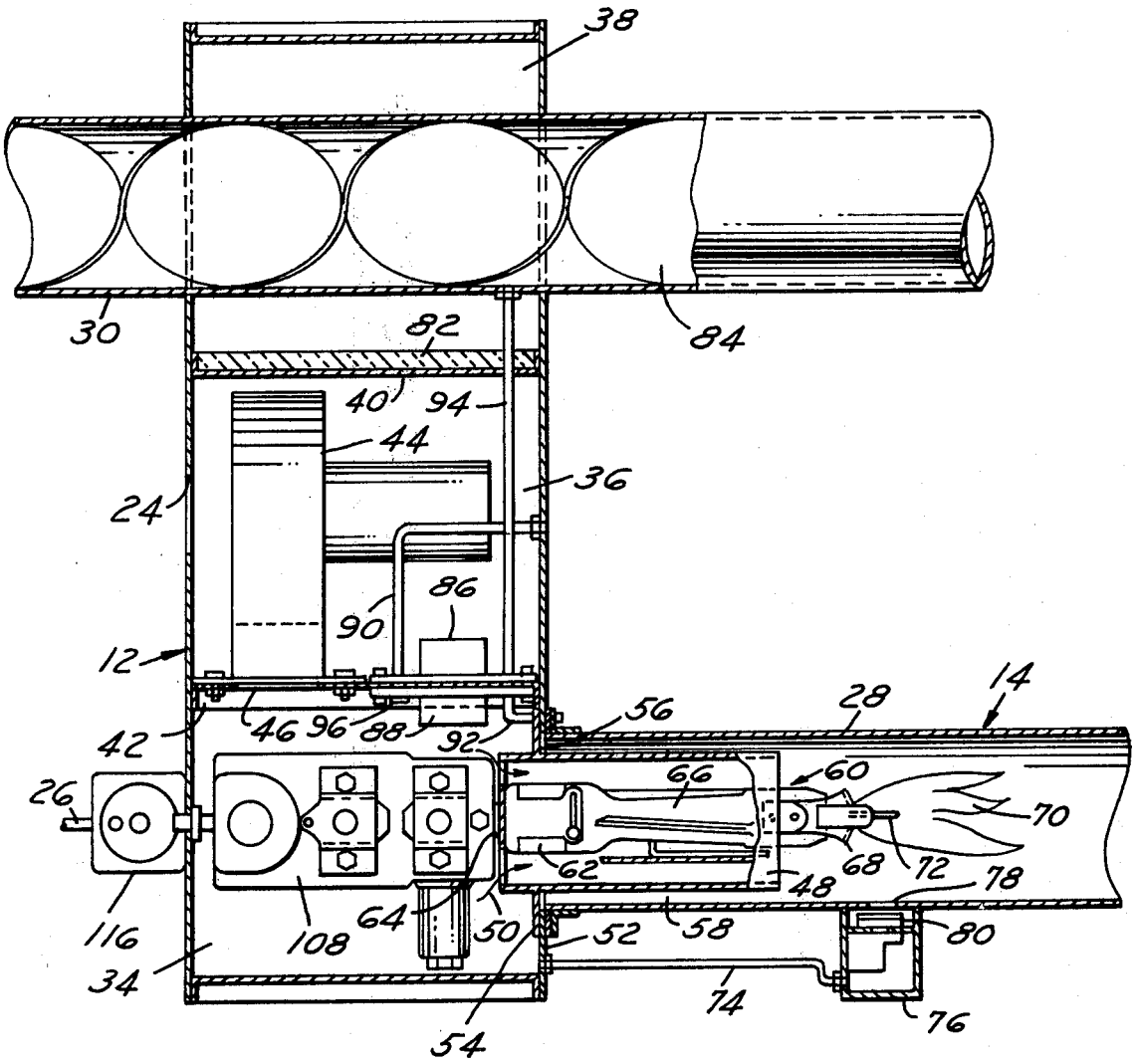
FIG. 3 is a sectional view taken substantially along the line 3—3 of FIG. 1 looking in the direction of the arrows.

Referring now to FIG. 3, it will be noted that the housing 12 is internally divided into three compartments 34, 36, and 38. These compartments are gas sealed from each other by dividers 40, 42.

An air blower 44 is mounted within compartment 36. The blower draws ambient room air in through opening 24 and expels it into compartment 34 through opening 46. The amount and pressure of inlet air is controlled by the size of the blower and the blower inlet so as to result in an optimum air/fuel mixture.

The compartment 34 is completely sealed from the ambient atmosphere and therefor becomes pressurized as a consequence of operation of blower 44. The pressurized air is directed in three separate paths. Firstly, pressurized air passes into a relatively short tube 48 as shown by arrows 50. Tube 48 is mounted on compartment wall 52 (and centered in opening 56 of wall 52) by means of a bracket 54. The diameter of opening 56 is substantially the same as the diameter of U-shaped tube 14, both of which are larger than the diameter of the short tube 48. Tube 48 extends for a short distance within U-shaped tube 14 to define therewith a cylindrical passageway 58.

The major portion of the air which enters tube 48 is drawn into burner 60 through opening 62 by a stream of gaseous fuel which enters the burner 60 via line 64. The air and fuel flow through a venturi tube portion 66 of the burner 60 which results in suitable mixing of the air and fuel for ignition. A flame arrestor 68 is provided at the outlet of burner 60 to limit the extent of the flame 70.

The air/fuel mixture is ignited by means of an ignitor 72. An ignitor of the glow bar type is provided although other types of ignitors may be used.

The second path for the pressurized air from compartment 34 is through opening 56 and into the cylindrical passageway 58. A cylinder of relatively cool air exits from the end of the tube 48 as a constant stream to thereby surround the flame 70. This prevents the flame 70 from impinging on the U-shaped tube 14. The high temperature of flame 70 and early products of combustion would cause deterioration of tube 14 if this protection were not provided.

The third path for pressurized air from the compartment 34 is via a tube 74 which extends between compartment 34 and substantially gas-tight housing 76. The housing 76 is mounted on tube 14 over an opening 78 which is in line with ignitor 72 and flame 70. A radiant sensor 80 is mounted in housing 76 in line with opening 78. Sensor 80 has normally closed single pole, single throw contacts and is calibrated to open the contacts when the ignitor 72 reaches a specified temperature, for example, 2200° F. When ignition occurs, heat from flame 70 will hold the switch contacts open. This function forms part of the control circuit of FIG. 4 as will be later described.

Pressurizing housing 76 with air performs three important functions. Firstly, as this air flows through the opening into tube 14,78, there is a constant cushion or pocket of air in front of the sensor 80. This protects the sensor from the heat of burning and against sudden surges of flame 70 which would impinge against the sensor. Secondly, the stream of air cools the sensor. Thirdly, if housing 76 should not be sealed entirely gas-tight, as desired, any leakage would be of air and not hot combustion gases or unburned fuel.

The exhaust end 30 of the U-shaped tube 14 extends entirely through the compartment 38. Thermal insulating material 82 is provided on divider 40 to shield compartment 36 from radiated heat. An elongated sinuous deflector 84 is provided in exhaust end 30 to cause the exhaust gases to follow a helical path. Deflector 84 serves to control the velocity of the exhaust gases and to control the pressure and velocity of the gases within U-shaped tube 14. A pair of differential pressure switches 86,88 are mounted on divider 42. One tube 90 extends from switch 86, passes through housing 12 and terminates externally thereof to provide switch 86 with an atmospheric pressure reference. Similarly, tube 92 provides switch 88 with an atmospheric reference. A tube 94 extends from switch 86 through divider 40 and terminates within exhaust end 30 of U-shaped tube 14. Switch 88 communicates with compartment 34 by means of an opening 96.

The function of switches 86,88 is to shut down the heating system 10 when the exhaust pressure is too high or when the inlet air pressure is too low. These switches are calibrated at what are considered to be proper safety levels. The inlet air pressure may be too low if, for example, the blower 44 fails or if there is an obstruction into the blower inlet. The exhaust pressure may be too high if the exhaust outlet is blocked.

Figure 4:
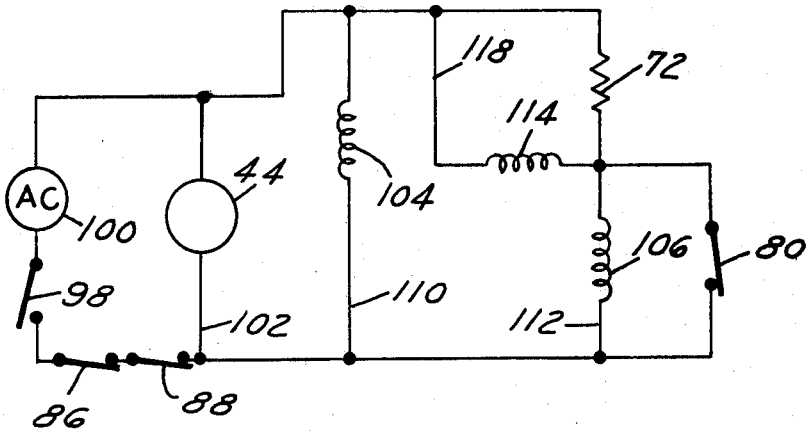
FIG. 4 is a schematic illustration of the electrical control means for the heating system.

The electrical control means for the heating system 10 are shown in FIG. 4. The circuit includes manually operable switch 98 which serves to close the circuit to electrical power 100. The differential pressure switches 86,88 are in series with switch 98. These switches have normally closed contacts. Should either switch open as a result of low or high pressures, as previously described, the entire control circuit will be de-energized, thereby shutting the heating system down.

A lead 102 connects the blower 44 across power. Closure of switch 98 therefor energizes the blower 44.

Two coils 104,106 of a solenoid gas valve 108 are connected across power by leads 110,112. The ignitor 72 is positioned in lead 112 between coil 106 and power. A third coil 114 of a second solenoid gas valve 116 is connected to parallel with ignitor 72 by lead 118.

As may be seen in FIG. 3, the valves 108,116 are connected in series between the fuel intake line 26 and burner 60. It is therefor necessary for both valves to be open in order for fuel to flow into the burner 60. Valve 116 functions as a safety valve. It will close the system down upon opening if any of switches 86,88,98 even if valve 108 should fail to operate. Valve 116 opens whenever switch 98 is manually closed.

It is necessary that both coils 104,106 of valve 108 be energized for the valve to open. Coil 104, which is energized upon closure of switch 98, will hold the valve open after it has been opened by energization of both coils.

As will be noted in FIG. 4, the normally closed contacts of sensor 80 are connected in parallel with coil 106. This creates a shunt around coil 106 which prevents this coil from being energized as long as the sensor's contacts are closed. As previously described, sensor 80 is not activated until the ignitor 72 reaches a predetermined temperature, for example, 2200° F. Therefor, upon closure of switch 98, valve 116 will open and ignitor 72 will energize. As soon as the ignitor 72 reaches the desired temperature, the sensor 80 is activated and its contacts open. The rail 106 is energized and valve 108 opens thus permitting flow of fuel to the burned 60. The energization of coil 106 prevents sufficient current flow through the ignitor 72 to cause it to heat appreciably. The ignitor 72 at this time is still sufficiently hot to cause ignition. As previously discussed, the heat from flame 70 will thereafter maintain the sensor in the activated state so as to maintain the contacts open.

If electrical power is interrupted, it is necessary to restart the system as above described.

Having thus described my invention, I claim:

1. A tube-fired radiant heating system comprising an elongated radiant heating tube having an inlet end and an exhaust end, a relatively short tube of smaller diameter than said elongated tube and spaced from the inner surface thereof to define therewith a cylindrical passage for flow of air, a burner positioned within said relatively short tube, said burner having an inlet end to receive air and fuel, means for mixing air and fuel, and an exit end for emitting the air/fuel mixture for combustion closely adjacent thereto, a pressurized housing defining an air tight compartment in gaseous communication with said inlet end of the elongated tube and the inlet end of the burner, and blower means for continually forcing air into said pressurized housing and through said cylindrical passage to form a cylinder of air around burning air/fuel mixture emitted from the burner to shield said elongated tube from impingement of the flame of burning air/fuel mixture.

2. A heating system as in claim 1, further characterized in that said elongated tube has an opening positioned to receive radiant energy from a burning air/fuel mixture, temperature sensing means mounted on said elongated tube externally thereof to receive radiant energy through said opening, a housing mounted on the elongated tube over and enclosing said temperature sensing means, and air passage means between said housing and the blower means to continually pass air into said housing and thence through said opening into the elongated tube to protect the temperature sensing means from burning air/fuel mixture and provide a positive pressure in said housing.

3. A heating system as in claim 1, further characterized in the provision of solenoid valve means connected to the inlet end of the burner for controlling the flow of fuel into the burner, electrical control means for automatically opening and closing said valve means, a differential pressure switch having normally closed contacts, said electrical control means including the normally closed contacts of the differential pressure switch, means communicating between said switch and said air tight compartment for measurement of the air pressure in the compartment, said switch being responsive to a predetermined unsafe low pressure in the air tight compartment to open its contacts and cause said valve means to close.

4. A heating system as in claim 3, further characterized in the provision of a second differential pressure switch, having normally closed contacts, said electrical control means including the normally closed contacts of the second differential pressure switch, means communicating between said second switch and the exhaust end of the elongated tube for measurement of the gas pressure in said exhaust end, said second switch being responsive to a predetermined unsafe high pressure in said exhaust end to open its contacts and cause said valve means to close.

5. A tube-fired radiant heating system comprising an elongated radiant heating tube having an inlet end and an exhaust end, a relatively short tube of smaller diameter than said elongated tube positioned in the inlet end of said elongated tube and spaced from the inner surface thereof to define therewith a cylindrical passage for flow of air, a burner positioned within said relatively short tube, said burner having an inlet end to receive air and fuel, means for mixing air and fuel, and an exit end for emitting the air/fuel mixture for combustion closely adjacent thereto, a housing defining an air tight compartment in communication with said inlet end of the elongated tube and the inlet end of the burner, blower means connected to said housing for suppling pressurized air thereto to continually force air into said inlet end of the burner and through said cylindrical passage to form a cylinder of air around burning air/fuel mixture emitted from the burner to shield said elongated tube from impingement of the flame of burning air/fuel mixture, said elongated tube having an opening positioned to receive radiant energy from a burning air/fuel mixture, temperature sensing means mounted on said elongated tube externally thereof to receive radiant energy through said opening, a housing mounted on the elongated tube over and enclosing said temperature sensing means, and air passage means between said housing and the blower means to continually pass air into said housing and thence through said opening into the elongated tube to protect the temperature sensing means from burning air/fuel mixture and provide a positive pressure in said housing.

6. A heating system as in claim 5, further characterized in the provision of solenoid valve means connected to the inlet end of the burner for controlling the flow of fuel into the burner, electrical control means for automatically opening and closing said valve means, a differential pressure switch having normally closed contacts, said electrical control means including the normally closed contacts of the differential pressure switch, means communicating between said switch and said air tight compartment for measurement of the air pressure in the compartment, said switch being responsive to a predetermined unsafe low pressure in the air tight compartment to open its contacts and cause said valve means to close.

7. A heating system as in claim 6, further characterized in the provision of a second differential pressure switch, having normally closed contacts, said electrical control means including the normally closed contacts of the second differential pressure switch, means communicating between said second switch and the exhaust end of the elongated tube for measurement of the gas pressure in said exhaust end, said second switch being responsive to a predetermined unsafe high pressure in said exhaust end to open its contacts and cause said valve means to close.

* * * * *